US010041283B2

(12) United States Patent
Zetti

(10) Patent No.: US 10,041,283 B2
(45) Date of Patent: Aug. 7, 2018

(54) SNAP HINGE WITH DAMPED CLOSING

(71) Applicant: D.G.N. S.R.L., Modena (IT)

(72) Inventor: Daniele Zetti, Modena (IT)

(73) Assignee: D.G.N. S.R.L., Modena (IT)

( * ) Notice: Subject to any disclaimer, the term of this patent is extended or adjusted under 35 U.S.C. 154(b) by 33 days.

(21) Appl. No.: 14/718,658

(22) Filed: May 21, 2015

(65) Prior Publication Data

US 2015/0337584 A1 Nov. 26, 2015

(30) Foreign Application Priority Data

May 23, 2014 (IT) ..... MO2014A0143

(51) Int. Cl.
*E05D 3/16* (2006.01)
*E05F 3/20* (2006.01)
(Continued)

(52) U.S. Cl.
CPC ..... *E05D 3/16* (2013.01); *E05D 11/105* (2013.01); *E05F 3/20* (2013.01); *E05F 5/10* (2013.01); *E05D 2003/163* (2013.01); *E05Y 2900/20* (2013.01); *Y10T 16/299* (2015.01); *Y10T 16/304* (2015.01)

(58) Field of Classification Search
CPC ..... E05D 3/16; E05D 2003/163; E05D 3/12; E05D 3/14; E05D 3/142
See application file for complete search history.

(56) References Cited

U.S. PATENT DOCUMENTS 2,686,332 A * 8/1954 Moon ..... A47B 1/04 108/81
4,083,082 A * 4/1978 Holmes ..... E05D 3/142 16/288
(Continued)

FOREIGN PATENT DOCUMENTS

DE 202007004621 U1 8/2008
EP 0361020 A1 4/1990
WO 2014061041 A1 4/2014

OTHER PUBLICATIONS

Italian Search Report of corresponding application IT MO20140143; dated Feb. 5, 2015; 8 pages.
(Continued)

*Primary Examiner* — Jeffrey O'Brien
(74) *Attorney, Agent, or Firm* — Brooks Kushman P.C.

(57) ABSTRACT

A snap hinge with damped closing includes a first articulated quadrilateral defined by a coupling plate associated with a fixed element, a first lever and a third lever, which are articulated to the coupling plate, and a second lever interposed between the preceding levers and is articulated thereto. A second articulated quadrilateral has a fixing plate associated with a movable element with which are associated and articulated respective ends of the second lever and of a fourth lever, the opposite end of which is associated and articulated with the first lever. The plates have various arrangements with respect to each other, rotating about a substantially horizontal rotation axis as the hinge moves between the open and closed configurations. The hinge has at least one damping element that acts during closing and is interposed directly between the coupling plate and the second lever.

14 Claims, 6 Drawing Sheets

(51) Int. Cl.
*E05D 11/10* (2006.01)
*E05F 5/10* (2006.01)

(56) References Cited

U.S. PATENT DOCUMENTS 5,035,026 A * 7/1991 Carlo ..... E05D 3/16 16/288
6,243,918 B1 * 6/2001 Zetti ..... E05D 3/16 16/293
6,374,459 B1 * 4/2002 Zetti ..... E05D 3/16 16/286
6,568,035 B2 * 5/2003 Zetti ..... E05D 3/16 16/286
7,100,241 B2 * 9/2006 Zetti ..... E05D 3/16 16/283
7,543,356 B2 * 6/2009 Zetti ..... E05D 3/16 16/238
7,574,775 B2 * 8/2009 Zetti ..... E05D 3/16 16/266
7,591,046 B2 * 9/2009 Zetti ..... E05D 3/16 16/286
7,797,796 B2 * 9/2010 Migli ..... E05D 15/40 16/286
7,934,290 B2 * 5/2011 Gherardi ..... A47L 15/4261 16/280
8,082,629 B2 * 12/2011 Migli ..... E05D 15/46 16/286
8,132,294 B2 * 3/2012 Spreafico ..... E05D 3/16 16/277
8,225,459 B2 * 7/2012 Waltemate ..... E05D 3/16 16/286
2006/0090296 A1 * 5/2006 Zetti ..... E05D 3/16 16/302
2006/0174444 A1 * 8/2006 Giovannetti ..... E05D 15/262 16/354
2007/0006420 A1 * 1/2007 Zetti ..... E05D 3/16 16/287
2008/0134464 A1 * 6/2008 Salice ..... E05F 1/1058 16/84
2009/0241288 A1 * 10/2009 Zetti ..... E05D 3/16 16/236
2014/0215761 A1 * 8/2014 Zetti ..... E05D 3/16 16/288
2015/0267452 A1 * 9/2015 Zetti ..... E05D 3/16 16/65

OTHER PUBLICATIONS

Office Action of European application No. EP 151682663; dated Apr. 10, 2017; 3 pages.

* cited by examiner

SNAP HINGE WITH DAMPED CLOSING

CROSS-REFERENCE TO RELATED APPLICATIONS

This application claims priority to Italian Application No. MO2014A000143 filed May 23, 2014, the disclosure of which is hereby incorporated in its entirety by reference herein.

TECHNICAL FIELD

The present invention relates to a snap hinge with damped closing.

BACKGROUND

With particular reference to the field of furniture, hinges are known which are interposed between a movable leaf and a structural frame that defines a compartment that is closed by the leaf, so as to allow the relative rotation of the leaf with respect to the frame between a closed configuration and an open configuration.

These hinges are constituted substantially by two articulated quadrilaterals, having two levers in common, and are preferably provided with elastic means for maintaining the closed configuration, so as to avoid the accidental opening of the leaf.

However, the presence of such elastic means, which are indispensable in some applications, involves a sudden closure of the leaf, which, if not accompanied, collides violently against the supporting structure, with the further risk of crushing for the users or for any objects not stored correctly in the compartment.

SUMMARY

In order to obviate these drawbacks, various solutions have been developed in order to obtain a damped closure which provide for the insertion of closure damping elements that are external to the hinge or are directly embedded.

These damping elements are particularly useful in applications in which the leaf has a substantially vertical arrangement and is hinged in an upward region about a substantially horizontal axis, in order to prevent the leaf from slamming against the structure under the action of its own weight.

Among solutions with embedded damping elements, in particular, a version of snap hinge is known in which the damping element is interposed between the plate for fixing the hinge to the leaf, which acts as a frame for the adjacent articulated quadrilateral, and an arm of the quadrilateral.

This configuration, in view of the bulk of the damping element in the closed configuration, prevents the leaf from performing a rotation of more than 90° between the open and closed configurations.

In some applications, for example for shelves of caravans or vehicles in general, solutions that, without modifying the shape of the structural elements, allow an arrangement that is inclined at an angle of less than 90° of the leaf in the closed configuration with respect to the horizontal upper frame, so as to increase the useful space available to passengers, are interesting.

As an alternative, solutions are known in which the damping element can be arranged also between the plate for coupling to the fixed structure and the articulated quadrilateral that is adjacent thereto, by interposition of additional elements for the pivoting of the element.

These solutions, too, are not devoid of drawbacks, which include the fact that they entail the provision and assembly of additional elements, which increase the complexity of the structure of the hinge, increasing its production costs and reducing its reliability, in view of the greater likelihood of breakages or jamming.

The aim of the present invention is to eliminate the drawbacks cited above of the known solutions, by devising a snap hinge with damped closing that allows to increase the movement angle of the leaf between the open and closed configurations and therefore the flexibility of application of the hinge, without increasing the complexity of its structure.

Within this aim, another object of the present invention is to be economically convenient and competitive, and to be highly reliable and durable in operation.

A further object of the present invention is to provide a structure that is simple, relatively easy to provide in practice, safe in use, effective in operation and relatively low in cost.

This aim and these objects are all achieved by the present snap hinge with damped closing, comprising a first articulated quadrilateral that comprises a coupling plate that can be associated with a fixed element, a first lever and a third lever, which are articulated to the coupling plate, and a second lever, which is interposed between the preceding levers and is articulated thereto, and a second articulated quadrilateral that comprises a fixing plate that can be associated with a movable element with which are associated and articulated respective ends of the second lever and of a fourth lever, the opposite end of which is associated and articulated with the first lever, the hinge being adapted to assume alternately an open configuration and a closed configuration, in which the plates have various main arrangements with respect to each other, rotating about a substantially horizontal rotation axis, characterized in that it comprises at least one damping element that acts during closing and is interposed directly between the coupling plate and the second lever, the damping element having mutually opposite ends thereof articulated about respective fixed pivots associated with the fixing plate and with the second lever.

BRIEF DESCRIPTION OF THE DRAWINGS

Further characteristics and advantages of the present invention will become better apparent from the detailed description of two preferred but not exclusive embodiments of a snap hinge with damped closing, illustrated by way of non-limiting example in the accompanying drawings, wherein.

DETAILED DESCRIPTION

Figure 1:
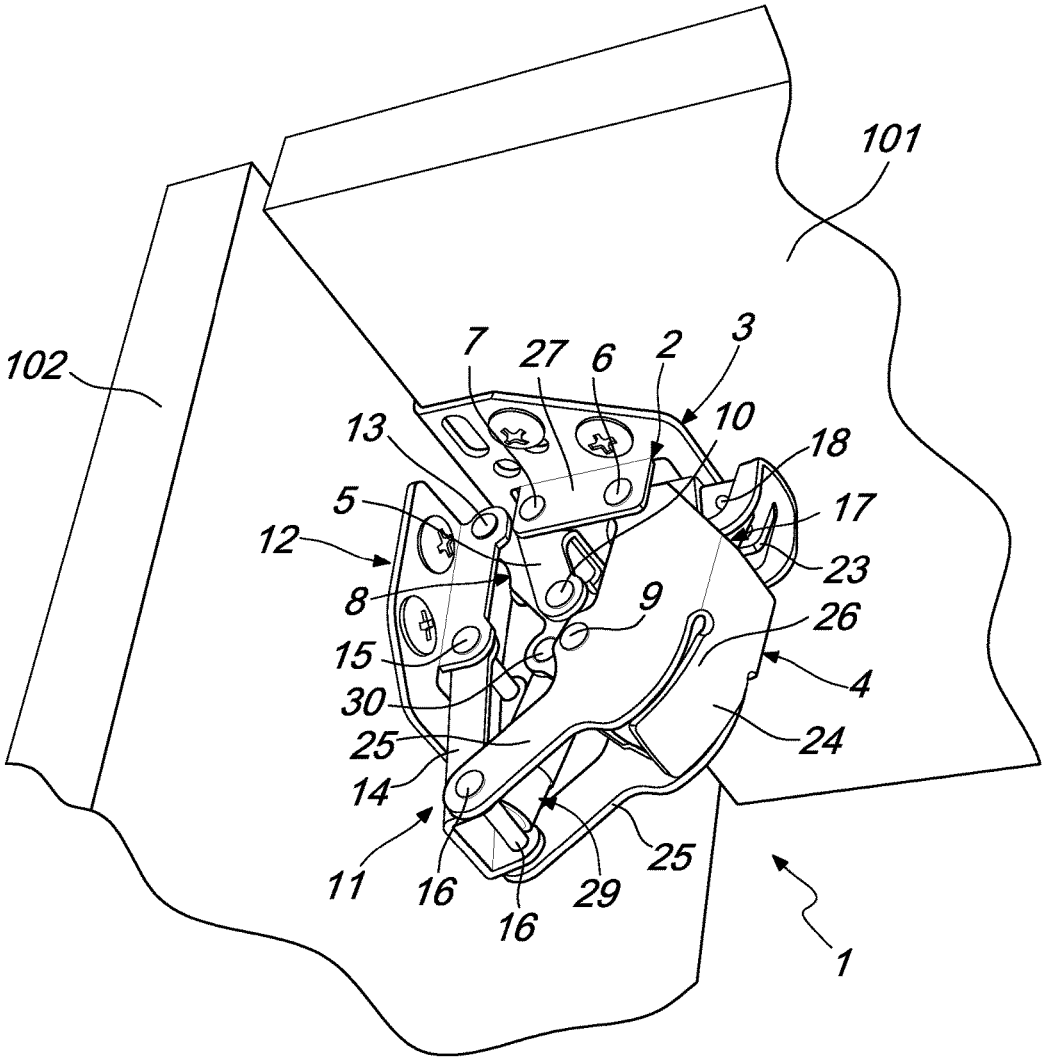
FIG. 1 is a schematic perspective bottom view of a first embodiment of a snap hinge with damped closing, according to the invention, in the closed configuration.

With reference to the figures, a snap hinge with damped closing has been designated generally by the reference numeral 1.

The hinge 1 comprises a first articulated quadrilateral 2, constituted by a plate 3 for coupling to a fixed element 101, by a first lever 4 and by a third lever 5 having respective first ends associated with the coupling plate 3 by means of respective pivoting pivots 6 and 7 and by a second lever 8 that is interposed between the previous ones and is articulated thereto about respective pivoting pivots 9 and 10.

The coupling plate 3 has a pair of first side walls 27 for supporting the pivots 6 and 7, only one of which is shown in the figures and which protrude from the main plane of arrangement of the plate on the side that lies opposite the one intended to adhere to the fixed element 101.

The hinge 1 comprises, moreover, a second articulated quadrilateral 11 having two levers in common with the first articulated quadrilateral 2.

In particular, the second articulated quadrilateral 11 is composed of a plate 12 for fixing to a movable element 102, by the second lever 8, which has an end pivoted to the plate about a respective pivot 13, by a fourth lever 14, the opposite ends of which are pivoted to the fixing plate 12 and to the first lever 4 about respective pivots 15 and 16, and by the first lever.

The fixing plate 12 is provided with a pair of second side walls 28 for supporting the pivots 13 and 15, only one of which is shown in the figures and which protrude from the main plane of arrangement of the plate on the side that lies opposite the one intended to adhere to the movable element 102.

In use, the hinge 1 is intended to be interposed between a fixed element 101, such as a wall of a frame wall of a furniture element that defines a compartment, and a movable element 102, such as a leaf for closing the compartment.

Therefore, the hinge 1 is adapted to be moved between a closed configuration and an open configuration, in which the coupling plate 3 and the fixing plate 12 have mutually different main arrangements, rotating about a substantially horizontal rotation axis.

The hinge 1 is particularly intended to be mounted on furniture elements in which the movable element 102 hangs from the fixed element 101 arranged in an upward region and articulated thereto about a substantially horizontal axis, such as the shelves typically provided in campers, caravans and the like.

According to the invention, the hinge 1 has at least one damping element 17 that acts during closing and is directly interposed between the coupling plate 3 and the second lever 8, with the corresponding ends articulated about respective pivots 18 and 19 that are fixed and associated, respectively, with the coupling plate 3 and with the second lever 8.

In the application described above, the presence of the damping element 17 prevents the movable element 102 from closing violently under the action of its own weight even if it is not guided by the user.

In greater detail, the damping element 17 comprises a cylindrical jacket 20 in which a stem 21 is inserted slidingly. The jacket 20 and the stem 21 are associated respectively with the second lever 8 and with the coupling plate 3 by way of the pivots 19 and 18.

In the open configuration of the hinge 1, the damping element 17 is in a compression position, with the stem 21 retracted inside the jacket 20, while in the closed configuration the damping element 17 is in an extension position, with the stem 21 that protrudes from the jacket 20. The damping element 17 comprises braking means of a known type, such as one-way valves not detailed in the drawings, for the decelerated transition from the compression position to the extension position.

The second lever 8 comprises a tab 22 that protrudes beyond the pivot 9 for pivoting to the first lever 4, at which there is the pivot 19 for pivoting the second lever with the jacket 20.

Moreover, the coupling plate 3 is provided with a pair of wings 23, only one of which is shown in the figures, for supporting the pivot 18 for pivoting the stem 21 to the plate, so as to avoid lateral movements of the stem 21 with respect to its longitudinal extension.

Advantageously, the first lever 4 has at least one central portion 24 that is saddle-shaped so as to accommodate in the corresponding concave region the tab 22 and the damping element 17.

More precisely, the first lever 4 is constituted by two plates 25 that are contoured and arranged parallel to each other and between which a connecting bridge 26 is interposed at the central portion 24.

At the pivot 16 the plates 25 are arranged on opposite sides of the fourth lever 14, while at the pivot 6 the plates 25 are arranged inside the first side walls 27.

Moreover, there can be first elastic means 29 for maintaining the open configuration which are interposed between the levers of the second articulated quadrilateral 11, which support the weight of the movable element 102 in the open configuration.

The first elastic means 29 can provide an encapsulated spring pivoted to the pivot 16 for the pivoting of the fourth and first levers, respectively, 14 and 4, and to a further pivot 30 associated with the second lever 8 between the pivots 9 and 10.

There can be, furthermore, second elastic means 32 for maintaining the open configuration which are interposed between the elements of the first articulated quadrilateral 2, which cooperate with the first elastic means 29 to support the weight of the movable element 102 in the open configuration. In particular, the second elastic means 32 are interposed between the coupling plate 3 and the first lever 4 and can provide an encapsulated spring that is pivoted to the coupling plate 3 and to the first lever 4 about respective pivots 33 and 34.

Figure 2:
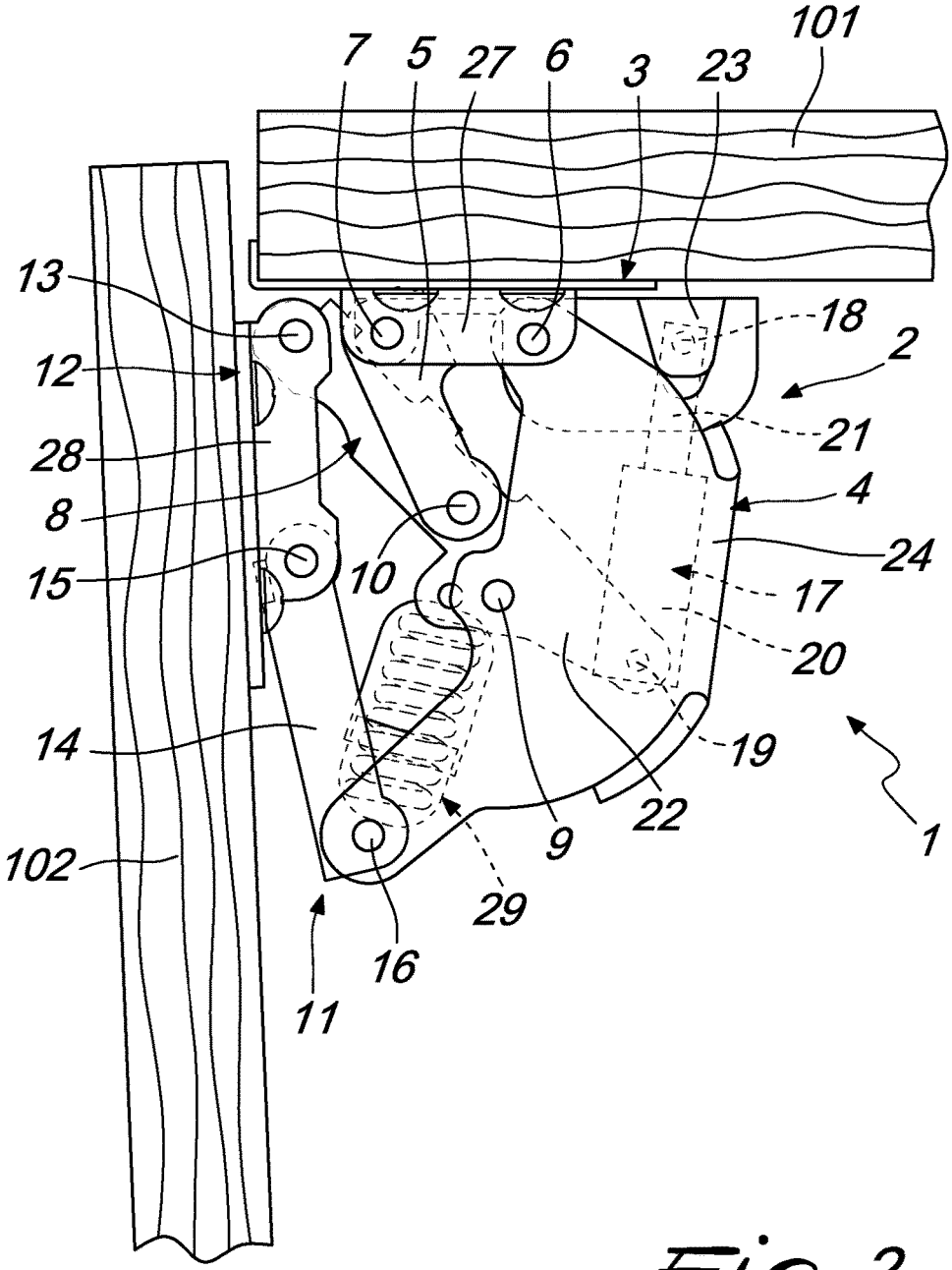
FIG. 2 is a schematic side elevation view of the hinge of FIG. 1.
Figure 3:
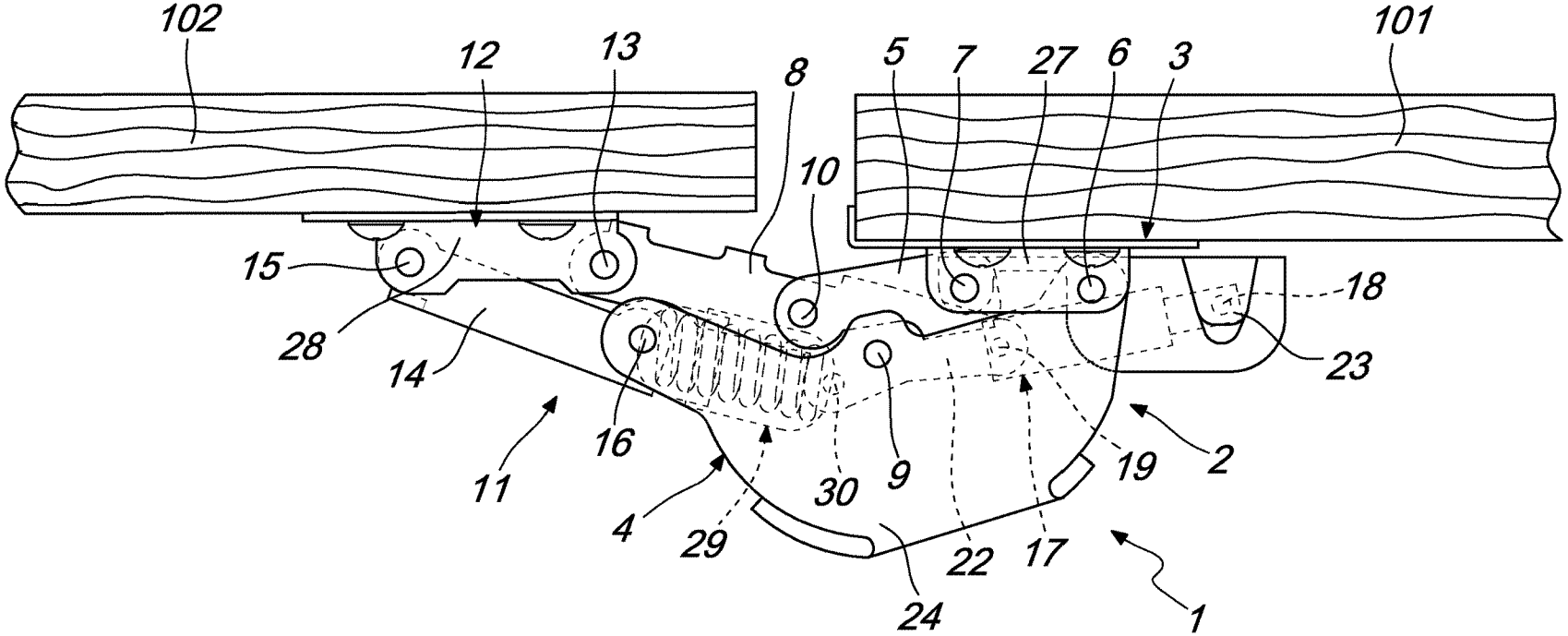
FIG. 3 is a schematic side elevation view as in FIG. 2, but in the open configuration.

FIGS. 1 to 3 show a first embodiment of the hinge according to the invention, in which the coupling plate 3 and the fixing plate 12 have their respective main arrangements that define an acute angle in the closed configuration (FIGS. 1 and 2) and are substantially parallel in the open configuration (FIG. 3), the rotation angle between the open and closed configurations being greater than 90°.

In this case only the first elastic means 29 are provided.

Typically, this version is intended to be applied to furniture in which the fixed element 101 has a horizontal or substantially horizontal arrangement and the movable element 102 is pivoted in an upward region about a horizontal axis.

Figure 4:
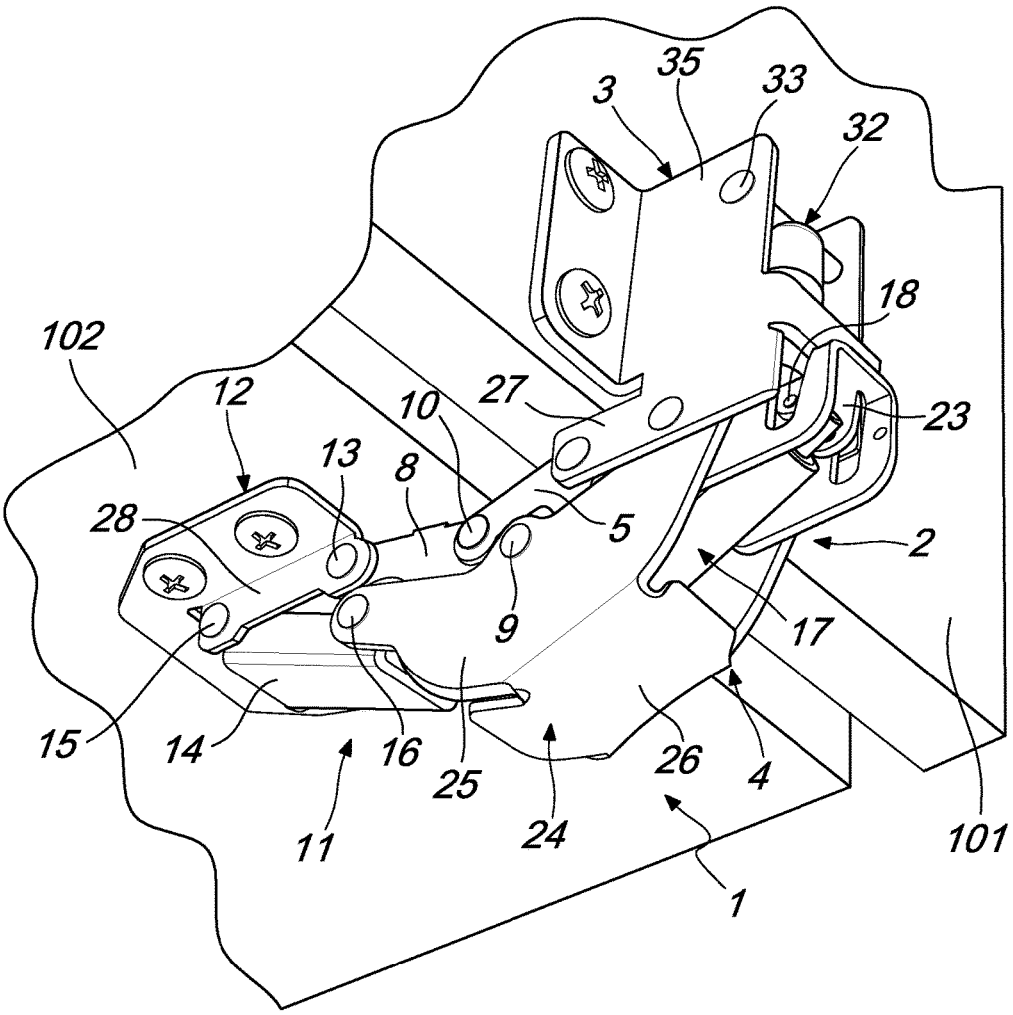
FIG. 4 is a schematic perspective bottom view of a second embodiment of a snap hinge with damped closing, according to the invention, in the open configuration.
Figure 5:
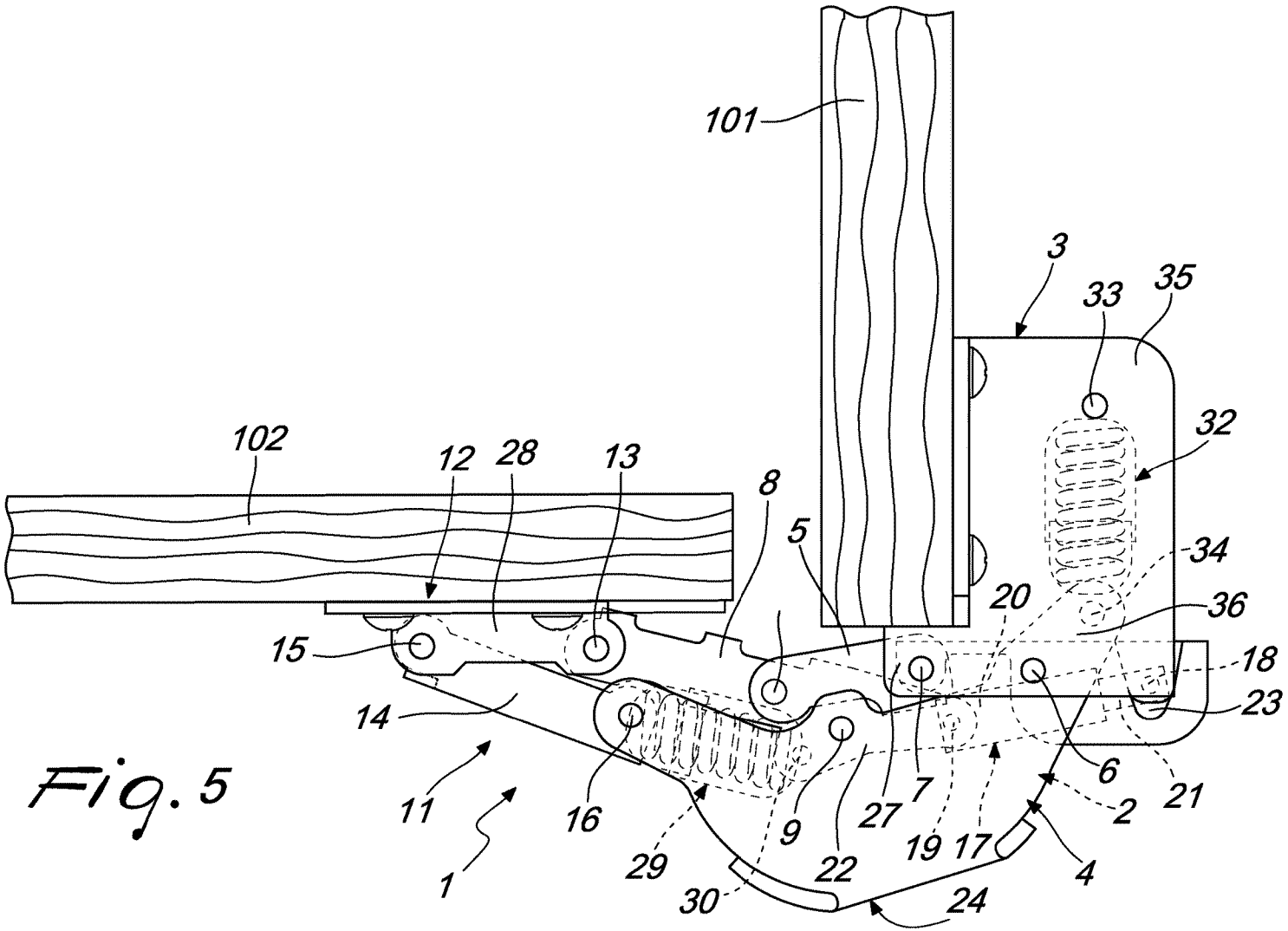
FIG. 5 is a schematic side elevation view of the hinge of FIG. 4.
Figure 6:
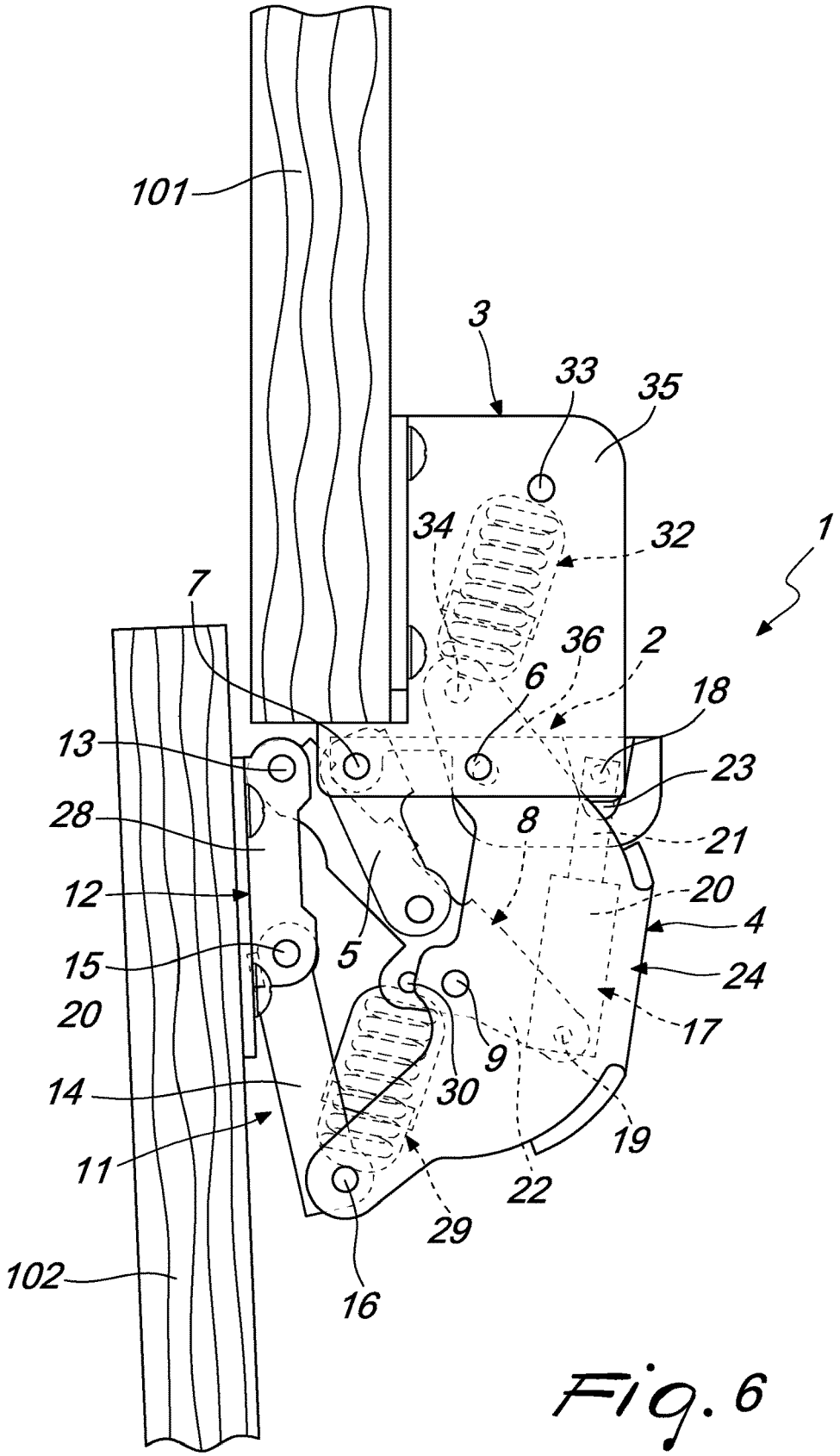
FIG. 6 is a schematic side elevation view as in FIG. 5, but in the closed configuration.

FIGS. 4 to 6 show a second embodiment of the hinge according to the invention, in which the coupling plate 3 and the fixing plate 12 have the respective main arrangements that define an obtuse angle that is close to 180° in the closed configuration (FIG. 6) and are substantially perpendicular in open configuration (FIGS. 4 and 5), the rotation angle between the open and closed configurations being greater than 90°.

In this case both the first and second elastic means, respectively 19 and 32, are provided.

Moreover, the coupling plate 3 is composed of a substantially box-like main body 35 that defines the side walls 27 and on which the wings 23 are applied.

The pivot 33 is associated with the main body 35 and the first lever 4 extends beyond the pivot 6 at the corresponding first end to define a protrusion 36 that is accommodated so that it can move inside the main body 35.

Typically, this version is designed to be applied to furniture in which the fixed element 101 has a vertical or substantially vertical arrangement and the movable element 102 rotates about a horizontal axis.

In practice it has been found that the described invention achieves the intended aim and objects and in particular the fact is stressed that the solutions according to the invention allow to increase the rotation angle of the hinge between the open and closed configurations and, therefore, to extend the possibilities of use thereof.

Moreover, the solutions according to the invention do not entail structural complications, but only the geometric modification of some components.

The invention thus conceived is susceptible of numerous modifications and variations, all of which are within the scope of the appended claims.

All the details may furthermore be replaced with other technically equivalent elements.

In practice, the materials used, as well as the contingent shapes and dimensions, may be any according to requirements without thereby abandoning the protective scope of the appended claims.

What is claimed is:

1. A snap hinge with damped closing, comprising:

a first articulated quadrilateral that comprises a coupling plate configured to be connected to a fixed element, and a first lever and a third lever, which are articulated to the coupling plate, and a second lever connected between the first and third levers to articulate at second and forth pivots, respectively;

a second articulated quadrilateral that comprises a fixing plate configured to be connected to a movable element, wherein the second lever and a fourth lever are articulated to the fixing plate and an opposite end of the fourth lever articulated with the first lever, the movable element being adapted to move alternately between an open configuration and a closed configuration relative to the fixed element, rotating about a substantially horizontal rotation axis; and at least one damping element that acts during closing and connected directly to the coupling plate and the second lever to articulate at opposite ends about respective fixed pivots on the coupling plate and the second lever, wherein the second lever comprises a tab that protrudes beyond a first pivot of the first articulated quadrilateral at which the first lever articulates relative to the second lever, wherein the at least one damping element is connected to the second lever along the tab at a second pivot point outside of the first and second articulated quadrilaterals.

2. The hinge according to claim 1, wherein the fixed pivot for pivoting between the coupling plate and the damping element is arranged on the opposite side of a first pivot on the coupling plate at which the first lever is connected from a third pivot on the coupling plate at which the third lever is connected.

3. The hinge according to claim 1, wherein the coupling plate comprises a pair of wings for supporting the fixed pivot for pivoting the damping element with respect to the coupling plate.

4. The hinge according to claim 1, wherein the first lever comprises at least one central portion that is saddle-shaped that forms a corresponding concave region, the tab and the at least one damping element accommodated in the concave region.

5. The hinge according to claim 1, wherein the at least one damping element comprises a jacket in which a stem is inserted slidingly, the jacket and the stem being associated and articulated respectively with the second lever and with the coupling plate about the respective fixed pivots.

6. The hinge according to claim 1, further comprising first elastic means for maintaining the open configuration which are associated with the second articulated quadrilateral.

7. The hinge according to claim 6, further comprising second elastic means associated with the first articulated quadrilateral in order to maintain the open configuration.

8. The hinge according to claim 1, wherein the coupling plate and the fixing plate are oriented at an acute angle in the closed configuration and are substantially parallel in the open configuration, the rotation angle between the open and closed configurations being greater than 90°.

9. The hinge according to claim 1, wherein the coupling plate and the fixing plate have respective main arrangements that define an obtuse angle that is close to 180° in the closed configuration and are substantially perpendicular in the open configuration, the rotation angle between the open and closed configurations being greater than 90°.

10. A furniture element, comprising at least one fixed element and at least one movable element that hangs from the fixed element and is articulated thereto about a substantially horizontal rotation axis by interposing at least one hinge according to claim 1, the coupling plate and the fixing plate being connected respectively to the fixed element and to the movable element.

11. A snap hinge with damped closing, comprising:

a coupling plate configured to be connected to a fixed element;

a fixing plate configured to be connected to a movable element, wherein the movable element is adapted to move alternately between an open configuration and a closed configuration relative to the fixed element, rotating about a substantially horizontal rotation axis;

a first and a third lever each directly connected to the coupling plate to pivot;

a second and fourth lever each directly connected to the fixing plate to pivot;

a first articulated quadrilateral defined by first quadrilateral pivot points on each of the coupling plate, the first lever, the third lever, and the second lever;

a second articulated quadrilateral defined by second quadrilateral pivot points on each of the fixing plate, the first lever, the fourth lever and the second lever; and a damper connected directly to the coupling plate and the second lever to pivot at fixed pivot points, wherein the fixed pivot point of the damper on the second lever is outside of the first and second quadrilateral pivot points on the second lever.

12. The hinge according to claim 11, wherein the second lever has a first pivot of the first articulated quadrilateral and a second pivot of the second articulated quadrilateral, the second lever having a tab that protrudes beyond the first and second pivot points, wherein the second fixed pivot point of the damper is connected to the second lever along the tab.

13. The hinge according to claim 12, wherein the first lever defines a concave region, wherein the tab and the damper are positioned in the concave region.

14. The hinge according to claim 11, wherein the coupling plate and the fixing plate are oriented at an acute angle in the closed configuration and are substantially parallel in the open configuration, a rotation angle between the open and closed configurations being greater than 90°.

* * * * *